US009828833B2

(12) United States Patent
Hofman et al.

(10) Patent No.: US 9,828,833 B2
(45) Date of Patent: Nov. 28, 2017

(54) DOWNHOLE TOOL WITH COLLAPSIBLE OR EXPANDABLE SPLIT RING

(71) Applicant: Peak Completion Technologies, Inc., Midland, TX (US)

(72) Inventors: Raymond Hofman, Midland, TX (US); William Sloane Muscroft, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 468 days.

(21) Appl. No.: 14/466,924

(22) Filed: Aug. 22, 2014

(65) Prior Publication Data

US 2015/0167428 A1 Jun. 18, 2015

Related U.S. Application Data

(63) Continuation-in-part of application No. 13/423,158, filed on Mar. 16, 2012, now abandoned, and a continuation-in-part of application No. 13/448,284, filed on Apr. 16, 2012, now abandoned.

(60) Provisional application No. 61/868,867, filed on Aug. 22, 2013, provisional application No. 61/453,288, filed on Mar. 16, 2011, provisional application No. 61/475,333, filed on Apr. 14, 2011.

(51) Int. Cl.

| | |
|---|---|
| ***E21B 34/16*** | (2006.01) |
| ***E21B 43/26*** | (2006.01) |
| ***E21B 34/14*** | (2006.01) |
| *E21B 34/00* | (2006.01) |

(52) U.S. Cl.
CPC ..... *E21B 34/16* (2013.01); *E21B 34/14* (2013.01); *E21B 43/26* (2013.01); *E21B 2034/007* (2013.01)

(58) Field of Classification Search
CPC .... E21B 2034/007; E21B 34/14; E21B 34/16; E21B 43/26
See application file for complete search history.

(56) References Cited

U.S. PATENT DOCUMENTS 6,131,662 A * 10/2000 Ross ..... E21B 17/07 166/242.7
7,322,417 B2 1/2008 Rytlewski et al.
(Continued)

*Primary Examiner* — Waseem Moorad
*Assistant Examiner* — Christopher Sebesta

(57) ABSTRACT

A valve assembly, and related system and method, with a sleeve having an inner surface with a diameter, an outer surface, and a plurality of openings extending between the inner surface and the outer surface. A split ring having one or more segments and an expandable or collapsible body with a seating surface and an outer diameter extending from the body is at least partially within the inner surface of the sleeve. The split ring and sleeve may be placed in a variable diameter housing such that contact of the outer diameter with a smaller diameter section of the housing causes the split ring to close, whereas contact with an larger diameter of the housing allows the split ring to open. In certain embodiments, a spring element, which may be the split ring itself, applies force to move the split ring from an open to closed position. A spring may be positioned around a portion of the sleeve and in an annular space at least partially defined by an annular body and the second cylindrical outer surface.

12 Claims, 16 Drawing Sheets

(56) References Cited

U.S. PATENT DOCUMENTS

| | | | | |
|---|---|---|---|---|
| 2004/0163820 | A1* | 8/2004 | Bishop | E21B 34/14 166/373 |
| 2006/0011347 | A1 | 1/2006 | Reimert | |
| 2007/0272420 | A1* | 11/2007 | Reimert | E21B 23/04 166/387 |
| 2010/0252276 | A1* | 10/2010 | Clausen | E21B 21/103 166/381 |
| 2011/0203800 | A1* | 8/2011 | Tinker | E21B 34/14 166/318 |

* cited by examiner

DOWNHOLE TOOL WITH COLLAPSIBLE OR EXPANDABLE SPLIT RING

CROSS-REFERENCES TO RELATED APPLICATIONS

This application claims the benefit of U.S. Provisional Patent Application Ser. No. 61/868,867, filed on Aug. 22, 2013 and entitled "Downhole Tool with Collapsible or Expandable Split Ring"; is a Continuation in Part, and claims the benefit, of U.S. patent application Ser. No. 13/423,158, filed Mar. 16, 2011 entitled "Multistage Production System Incorporating Valve assembly With Collapsible or Expandable C-Ring," which claims the benefit of U.S. Provisional Patent Application Ser. No. 61/453,288 and U.S. patent application Ser. No. 13/448,284, entitled "Assembly for Actuating a Downhole Tool" filed on Apr. 16, 2012, which claims the benefit of U.S. Provisional Application 61/475,333 filed Apr. 14, 2011 entitled "Valve Assembly and System for Producing Hydrocarbons", each of which is incorporated by reference herein.

STATEMENT REGARDING FEDERALLY-SPONSORED RESEARCH OR DEVELOPMENT

Not applicable.

BACKGROUND OF THE INVENTION

1. Field

The described embodiments and claimed invention relate to a tool for sequentially engaging and releasing a restrictor element, also referred to as plug, onto and from its corresponding valve seat, as well as systems and methods incorporating such a tool for producing hydrocarbons from multiple stages in a hydrocarbon production well.

2. Background of the Art

In hydrocarbon wells, tools incorporating valve assemblies having a restrictor element, such as a ball or dart, and a seat element, such as a ball seat or dart seat, have been used for a number of different operations. Such valve assemblies prevent the flow of fluid past the assembly and, with the application of a desired pressure, can actuate one or more tools associated with the assembly.

One use for such remotely operated valve assemblies is in fracturing (or "fracing"), a technique used by well operators to create and/or extend one or more cracks, called "fractures" from the wellbore deeper into the surrounding formation in order to improve the flow of formation fluids into the wellbore. Fracing is typically accomplished by injecting fluids from the surface, through the wellbore, and into the formation at high pressure to create the fractures and to force them to both open wider and to extend further. In many case, the injected fluids contain a granular material, such as sand, which functions to hold the fracture open after the fluid pressure is reduced.

Fracing multiple-stage production wells requires selective actuation of valve assemblies, such as fracing sleeves, to control fluid flow from the tubing string to the formation. For example, U.S. Published Application No. 2008/0302538, entitled Cemented Open Hole Selective Fracing System and which is incorporated by reference herein, describes one system for selectively actuating a fracing sleeve that incorporates a shifting tool. The tool is run into the tubing string and engages with a profile within the interior of the valve. An inner sleeve may then be moved to an open position to allow fracing or to a closed position to prevent fluid flow to or from the formation.

That same application describes a system using multiple valve assemblies which incorporate ball-and-seat seals, each having a differently-sized ball seat and corresponding ball. Frac valves connected to ball and seat seals do not require the running of a shifting tool thousands of feet into the tubing string and are simpler to actuate than frac valves requiring such shifting tools. Such ball and seat seals are operated by placing an appropriately sized ball into the well bore and bringing the ball into contact with a corresponding ball seat. The ball engages on a sealing section of the ball seat to block the flow of fluids past the valve assembly. Application of pressure to the valve assembly causes the valve assembly to "shift", opening the frac sleeve.

Some valve assemblies are selected for tool actuation by the size of ball or other restrictor element introduced into the well. If the well or tubing string contains multiple ball seats, the ball must be small enough that it will not seal against any of the ball seats it encounters prior to reaching the desired ball seat. For this reason, the smallest ball to be used for the planned operation is the first ball placed into the well or tubing and the smallest ball seat is positioned in the well or tubing the furthest from the wellhead. Thus, these traditional valve assemblies limit the number of valves that can be used in a given tubing string because each ball size is only able to actuate a single valve. Further, systems using these valve assemblies typically require each ball to be at least 0.125 inches larger than the immediately preceding ball. Therefore, the size of the liner restricts the number of valve assemblies with differently-sized ball seats. Certain seat assemblies may allow plug increments of 0.0625 inches, which provides more available seats, but still creates an upper limit on the total available plug sizes. In other words, because a plug must be larger than its corresponding plug seat and smaller than the plug seats of all upwell valves, each plug can only seal against a single plug seat and, if desired, actuate one tool.

The valve assembly provides a method for sequentially sealing multiple valve seats with a single restrictor element and, where desired, actuating tools associated with the valve assembly. One embodiment allows multiple balls, plugs or other restrictor elements of the same size to actuate tools in sequential stages.

BRIEF DESCRIPTION

The valve assemblies described herein comprise a split ring having a body with a seating surface and an external diameter extending radially from the body. In certain embodiments the split ring is a C-ring having terminated ends that may be compressed such that its terminal ends are in contact. Alternatively, the split ring may be in an uncompressed state wherein the terminal ends, for a C-ring, or the segment edges, for a multi-segmented ring, are not in contact. The split ring may also be comprised of a plurality of segments. The valve assembly further comprises one or more mounting elements, such as a variable diameter surface, to engage the outer diameter of the split ring. Engagement of mounting elements with the outer diameter causes the split ring to expand or contract.

Valve assemblies as described herein may further comprise a sleeve contained within a tubular housing, the sleeve having an inner surface, an outer surface, and a plurality of openings extending between said inner and outer surfaces. The openings are aligned to engage with the external diameter of the split ring. The tubular housing may have one or more mounting elements aligned within the openings in the sleeve, such that the mounting elements may engage the external diameter of the split ring when the sleeve is located at a desired position in the housing.

DETAILED DESCRIPTION

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during treatment of a well, which may include a fracturing, or "fracing," process, fluids move from the surface in the downwell direction to the portion of the tubing string within the formation to be treated.

Figure 1:
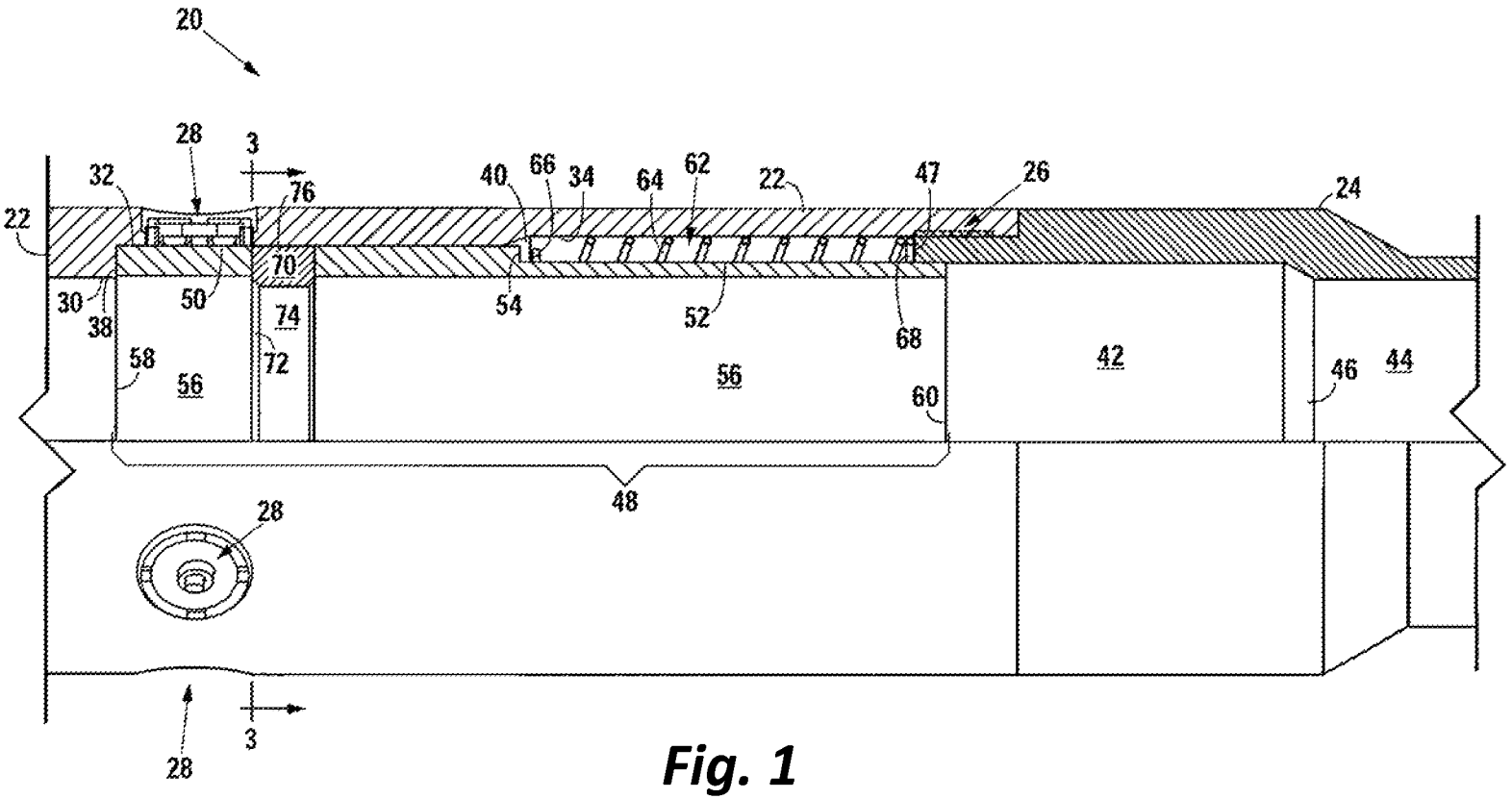
FIG. 1 is a side partial sectional view of a preferred embodiment valve assembly with an inner sleeve in an upwell first position.

FIG. 1 shows an embodiment tool 20, which comprises a housing 22 connected to a bottom connection 24 at a threaded section 26. The housing 22 has a plurality of radially-oriented, circumferentially-aligned ports 28 providing communication paths to and from the exterior of the tool.

The housing 22 has a first cylindrical inner surface 30 having a first inner diameter, a second cylindrical inner surface 32 located downwell of the first inner surface 30 and having a second inner diameter that is greater than the first inner diameter, and a third cylindrical inner surface 34 having a third inner diameter that is greater than the second cylindrical inner surface 32. The first inner surface 30 is longitudinally adjacent to the second inner surface 32, forming a downwell-facing shoulder having an annular shoulder surface 38. The second and third inner surfaces 32, 34 are separated by a partially-conical surface 40.

The bottom connection 24 includes a first cylindrical inner surface 42 having a first inner diameter and a second cylindrical inner surface 44 having a second inner diameter. The first and second inner cylindrical surfaces 42, 44 are separated by an inner partially-conical inner surface 46. An annular upper end surface 47 is adjacent to the first inner surface 42.

The tool 20 comprises an annular sleeve 48 nested radially within the housing 22 and positioned downwell of the shoulder 38. The sleeve 48 has an upper outer surface 50 with a first outer diameter and a second outer surface 52 with a second outer diameter less than the first inner diameter. The first outer surface 50 and second outer surface 52 are separated by an annular shoulder surface 54. The sleeve 48 further comprises a cylindrical inner surface 56 that extends between annular upper and lower end surfaces 58, 60 of the sleeve 48.

In FIG. 1, the sleeve 48 is in a first position radially between the plurality of housing ports 28 and the center of the flowpath. In this position, the annular sleeve 48 inhibits fluid flow between the flowpath and the exterior of the tool. The sleeve 48 extends between the shoulder 38 of the housing and the first inner surface 42 of the bottom connection 24.

The valve assembly may further comprise a guide element to position the split ring in the desired location. The guide element in the embodiment of FIG. 1 is a spring 64 residing in an annular spring return space 62. The annular spring return space 62 is partially defined by the second outer surface 52 of the sleeve 48 and the third inner surface 34 of the housing 22. The spring return space is further defined by the upper end surface 47 of the bottom connection 24, the partially-conical surface 40 of the housing 22, and the shoulder surface 54 and first outer surface 50 of the sleeve 48.

In the embodiment illustrated by the figures, the split ring is a C-ring 70 positioned within the annular sleeve 48 between the upper end surface 58 and the shoulder surface 54. The C-ring 70 fits into a groove formed in the inner surface 56 of the shifting sleeve 48. The groove is sufficiently deep to allow the C-ring seating surface to expand to the desired maximum diameter. In some embodiments, the desired maximum diameter may be as large as or larger than the inner diameter of the shifting sleeve. Those of skill in the art will appreciate that, in embodiments in which the C-ring activates a sleeve or other valve assembly, the C-ring 70 may be positioned at any point along the sleeve or tool, or above or below the sleeve, provided that the C-ring and the sleeve or other tool are connected such that sufficient pressure applied to the C-ring will slide the sleeve in relation to the inner housing or otherwise activate the tool.

The C-ring 70 has an inner surface 74 an outer surface 76 defining the outer perimeter of the C-ring, and a seating surface 72 engageable with a restrictor element having a corresponding size. In the illustrated embodiment, the C-ring 70 is held in a radially compressed state by the first inner surface 50 of the housing 22.

Figure 2:
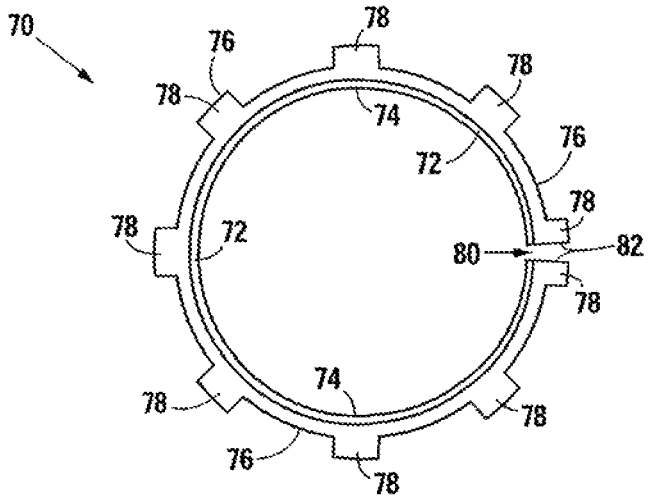
FIG. 2 is a front elevation of the C-ring of the preferred embodiment shown in FIG. 1.

FIG. 2 shows a front elevation of one embodiment of the C-ring 70 in a normal uncompressed state. In this embodiment, the outer surface 76 of the C-ring 70 is castellated with a plurality of radial protrusions 78, said radial protrusions defining the outer diameter of the C-ring. The circumference of the outer surface of the C-ring 70 may be larger than the circumference of inner surface 56 of the sleeve 48. The C-ring 70 has a machined slot 80 forming terminal ends 82. The slot 80 shown in the illustrative figures is within a protrusion 78, but the slot 80 may be formed at any point along the C-ring and does not have to be formed in a protrusion 78.

Figure 3:
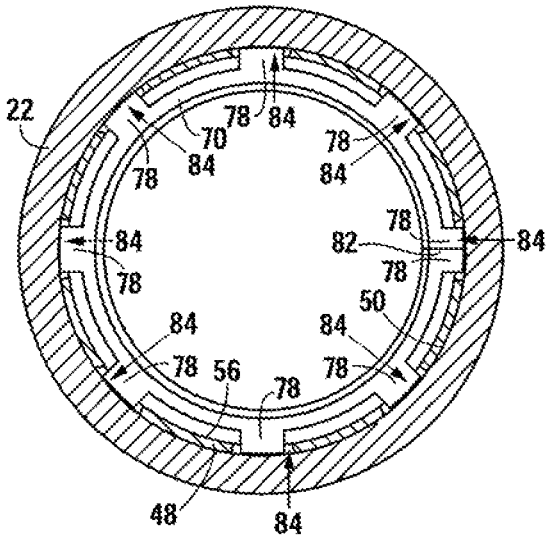
FIG. 3 is a sectional view through line 3-3 in FIG. 1.

Referring to the embodiment in FIG. 3, each of the radial protrusions 78 of the illustrated C-ring 70 is aligned with and extends through an opening 84 in the sleeve 48 between the first outer surface 50 and the inner surface 56. When the C-ring 70 is upwell of the partially-conical shoulder 40 of the housing 22, the C-ring 70 has the operating diameter shown in FIG. 3 and terminal ends 82 of C-ring 70 are in contact to form the seat defined by the seating surface 72. An associated ball may thereafter seat against the seating surface 72 and a pressure differential created across the ball to move the sleeve 48 in the downwell direction.

Figure 4:
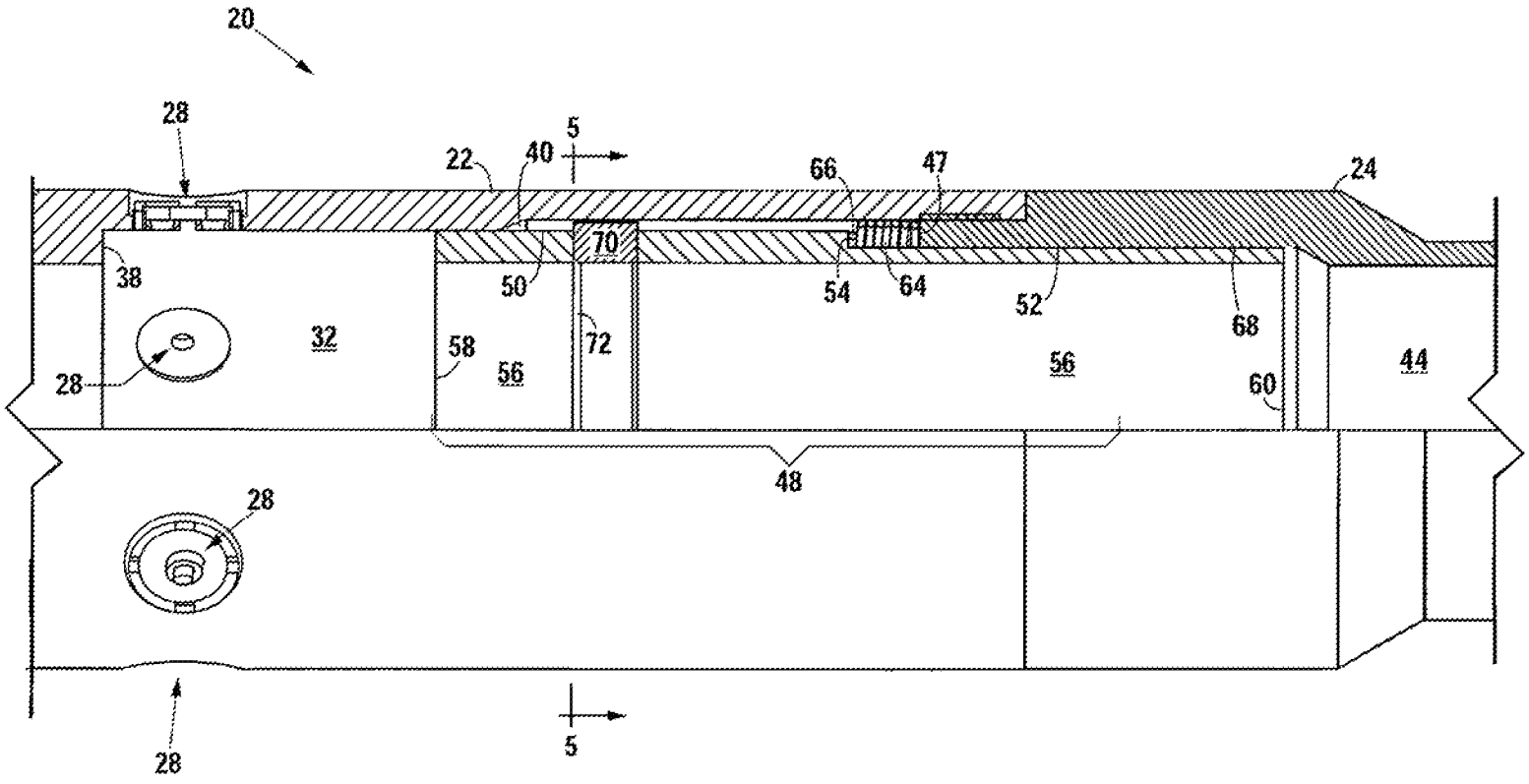
FIG. 4 is a side partial sectional view of a preferred embodiment valve assembly shown in FIG. 1 with the inner sleeve in a downwell second position.
Figure 5:
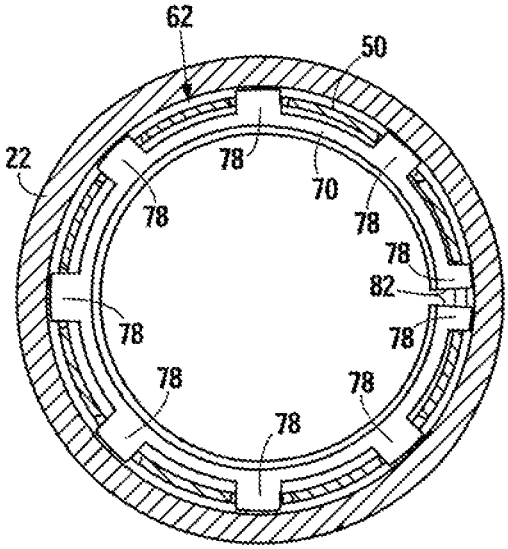
FIG. 5 is a sectional view through line 5-5 of FIG. 4.

FIGS. 4-5 show the tool 20 with the sleeve 48 in a second position, which is downwell of the first position in one preferred embodiment. The upper end surface 58 of the sleeve 48 has moved past the ports 28, allowing fluid flow therethrough between the flowpath and the exterior of the tool 20. The coil spring 64 is under compression between the sleeve 48 and the bottom connection 24, with the upper end coil 66 of the spring 64 in contact with the sleeve shoulder 54 and the spring lower end 68 is in contact with the upper end surface 47 of the bottom connection 24. In this position, the spring 64 exerts an expansive force to urge the sleeve 48 in the upwell direction relative to the bottom connection 24.

Referring to FIG. 5, the C-ring 70 is positioned adjacent to the third inner surface 34. Because the third inner surface 34 has a larger diameter than the second inner surface 32, the C-ring 70 radially expands towards its uncompressed shape shown in FIG. 2. The protrusions 78 extend past the outer surface 50 of the sleeve 48, opening the seating surface 72 and allowing the associated restrictor element to pass through the C-ring 70, after which the spring 64 pushes against the sleeve shoulder 54 to move the sleeve 48 upwell toward the first position shown in FIG. 1. Movement of the sleeve 48 past the position shown in FIG. 1 is limited by contact of the upper end surface 58 with the housing shoulder 38.

Figure 6:
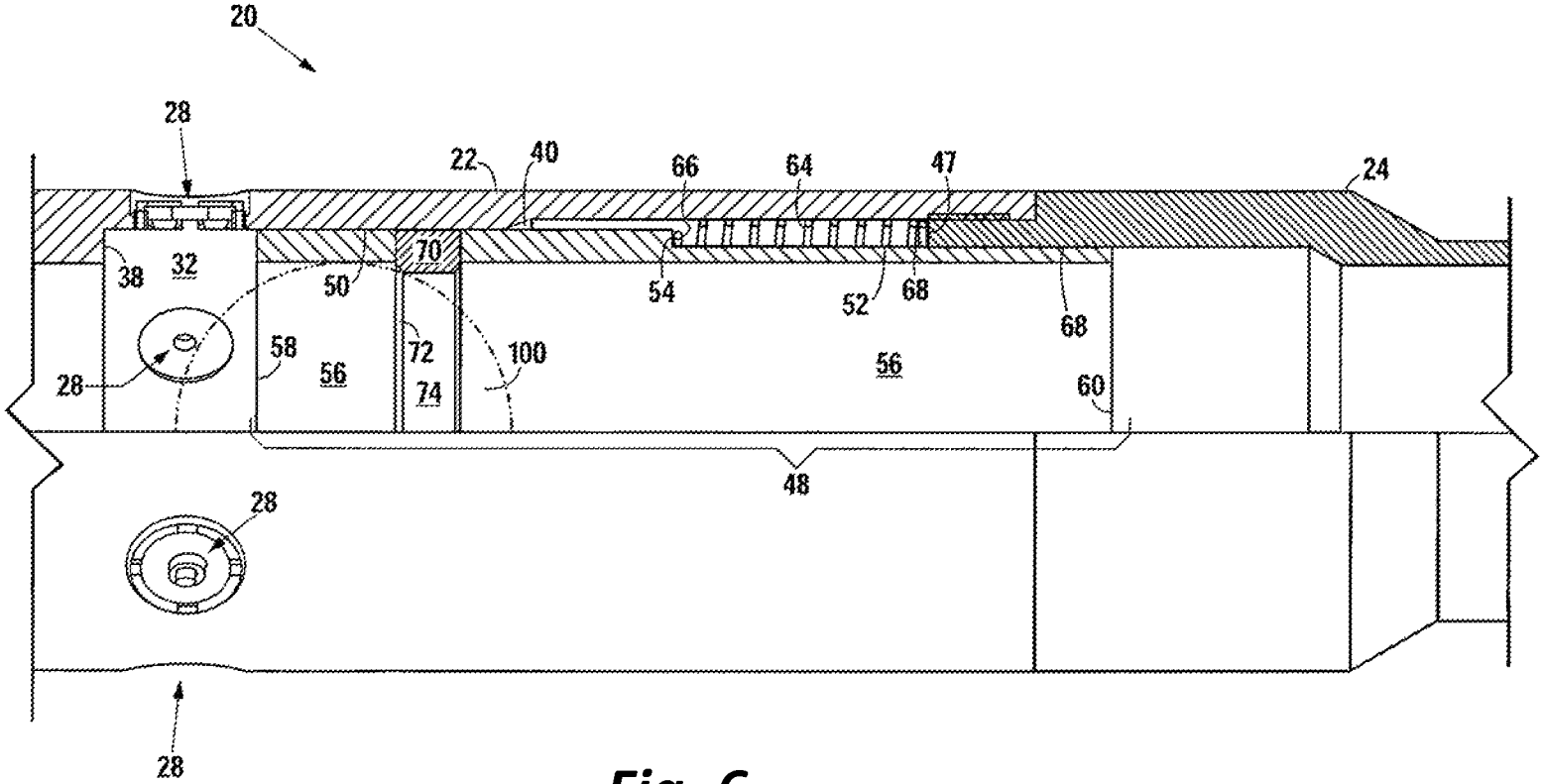
FIG. 6 is a side partial sectional view of the preferred embodiment with the inner sleeve in an intermediate position between the first and second positions described with reference to FIG. 1 and FIG. 4, respectively.

FIG. 6 shows the sleeve 48 in an intermediate third position between the first position shown in FIG. 1 and the second position shown in FIG. 4. A restrictor element 100 is seated against the seating surface 72 and obstructs fluid flow from through the C-ring 70 to create a differential pressure to move the sleeve 48 against the expansive force of the spring 64. The upper end surface 58 of the sleeve 48 is positioned such that the flow ports 28 are in fluid communication with the interior of the tool 20, allowing fluid communication between the interior of the tool 20 with the exterior of the tool 20. The C-ring 70 is held in a closed state by the second inner surface 32 of the housing 22. In some embodiments, a retaining element, not shown, may be placed in the sleeve to define this intermediate position, such retaining element being set such that it stops movement of the C-ring and sleeve up to a first pressure, but allows movement of the c-ring at a second pressure. Those of skill in the art will appreciate that many retaining elements such as a shear ring, shear pins, or other device may be used in conjunction with the valve assemblies described herein. Further, mechanisms, assemblies, methods or devices other than a retaining element may be used for defining the intermediate third position in a valve assembly and any such method or element is within the scope of the valve assemblies contemplated herein.

When the sleeve 48 is in the second position shown in FIG. 6, the well operator may thereafter cause the flow of fluids, including acid, fracing fluids, or other fluid desired by the operator, through the housing ports and into the formation adjacent to the tool. In the illustrated embodiment, flow of such materials will be blocked from downwell flow by the ball 100 positioned against the seating surface 72, causing flow to be directed to the surrounding formation through the housing ports 28. After fracing, the differential pressure across the ball 100 may be increased to cause the ball 100 to move the sleeve 48 further downwell to the position shown in FIG. 3, where upon the ball will be released by the expanding C-ring.

Figure 7:
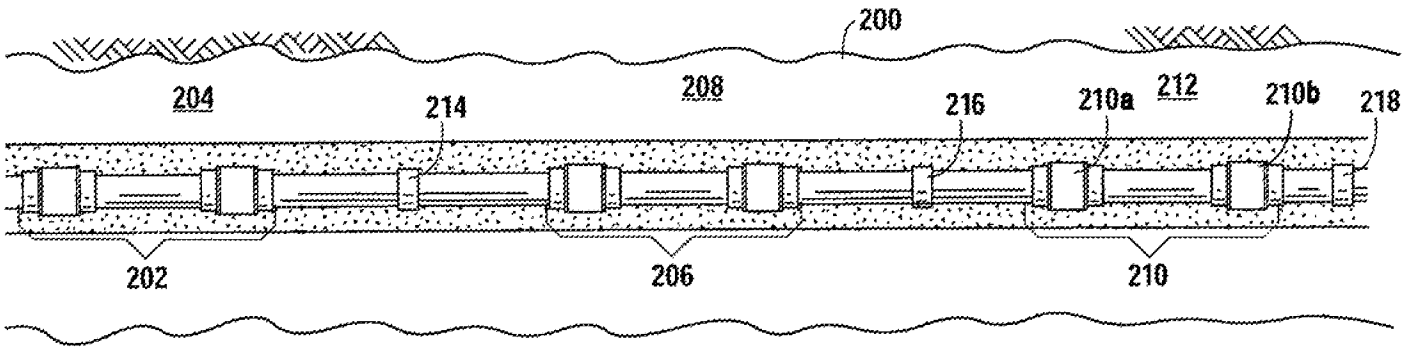
FIG. 7 is a side sectional elevation of a system incorporating multiple tools having the features of the preferred embodiment.

FIG. 7 shows a hydrocarbon producing formation 200 and a system comprising an upper set of tools 202 positioned in an upper stage 204 of the formation 200, an intermediate set of tools 206 positioned in an intermediate stage 208, and a lower set of tools 210 positioned within a lower stage 212. An upper static-seat tool 214 is positioned between the upper set of tools 202 and the intermediate set of tools 206 and has an internal ball seat corresponding to an upper-stage ball. An intermediate static-seat tool 216 is positioned between the intermediate set of tools 206 and the lower set of tools 210 and has an internal ball seat corresponding to an intermediate-stage ball. A lower static-seat tool 218 is positioned downwell of the lower set of tools and has an internal ball seat corresponding to a lower-stage ball. The static-seat tools 214, 216, 218 have ball seats designed to allow fluid flow therethough in either the upwell direction or the downwell direction, but the ball seats are not connected to sleeves or other movable components.

Each tool of the sets of the tools 202, 206, 210 has the features described with reference to FIGS. 1-6. Each tool within the upper set of tools 202 has a C-ring and associated sleeve sized to be actuated by the associated upper-stage ball. Each tool within the intermediate set of tools 206 has a C-ring and associated sleeve sized to be actuated by an associated intermediate ball smaller than the upper-stage ball. Each tool within the lower set of tools 210 has a C-ring and associated sleeve sized to be actuated by an associated lower-stage ball, which is smaller than the upper ball, and the intermediate-stage ball.

To actuate the lower set of tools 210, the lower-stage ball is caused to move through the tubing string and upper and intermediate sets of tools 202, 206. The lower-stage ball is sized to pass through the upper and intermediate sets of tools 202, 206 without being inhibited from further downwell flow by the corresponding ball seat inserts.

Upon reaching the upwell tool 210*a* of the lower set of tools 210, the lower-stage ball seats against the closed C-ring of the tool. The well operator can then increase the pressure within the tubing string to overcome the expansive force of the associated coil spring and shift the sleeve to the intermediate third position described with reference to FIG. 6. When desired, the pressure within the flowpath may be increased further to move the sleeve to the second position described with reference to FIG. 4. After moving the lower-stage ball through the C-ring, the pressure may be decreased to cause the lower-stage ball to seat against the closed C-ring of the lower tool 210*b* of the lower set of tools 210. While the lower set of tools 210 only shows two tools 210*a*, 210*b*, any number of similar tools may compose this stage. After moving through all of such tools, the lower-stage ball seals against the lower static-seat ball 218, which is sized to prevent passage therethrough up to a pressure which damages the structure of the ball This process may then be repeated, first with the intermediate stage 208 using the intermediate-stage ball with the intermediate sets of tools 206 and the intermediate static-seat tool 216, and second with the upper stage 204 using the upper-stage ball with the upper sets of tools 202 and upper static seat tool 214.

While the lower set of tools is shown comprising only three stages of tools, the process could be repeated for any number of tools within this stage. In addition, the same process described above with respect to the lower set of tools is repeatable in similar fashion for the intermediate and upper sets of tools 202, 206.

In an additional embodiment, the inwardly directed force exerted on the outer surface of the C-ring is caused by a plurality of dogs. In a preferred embodiment, the dogs are positioned in the openings 84 of the sleeve, and each dog has a surface corresponding to the curvature of the second inner surface 50 of the housing 22. The surface profile of the dogs may have other shapes provided the dogs can engage the protrusions 78 defining the outer surface of the C-ring 70 as desired. The dogs are aligned with and adapted to contact and exert a radially inward force on the protrusions 78 of the C-ring 70 to force the C-ring 70 into the compressed state. In this embodiment, the openings 84 have a length along the longitudinal axis of the sleeve to allow the C-ring and sleeve to move in relation to the dogs.

The dogs extend past first outer surface 50 of the sleeve 48, effectively reducing the diameter available to the protrusions. When the C-ring 70 is positioned such that that protrusions 78 engage the dogs, the terminal ends 82 are in contact and the diameter of the seating surface 72 and inner surface 74 of the C-ring 70 are such that a properly-sized ball flowing through the shifting sleeve will engage with the seat of the C-ring 70 as described with reference to FIGS. 1-7. In one embodiment, the C-ring and sleeve are engaged near the bottom of each of the openings 84 such that movement of the C-ring in the downwell direction moves the sleeve in the same direction and movement of the sleeve in the upwell direction, typically by the force of a spring or other guide device, will move the C-ring in the upwell direction.

Figure 8A:
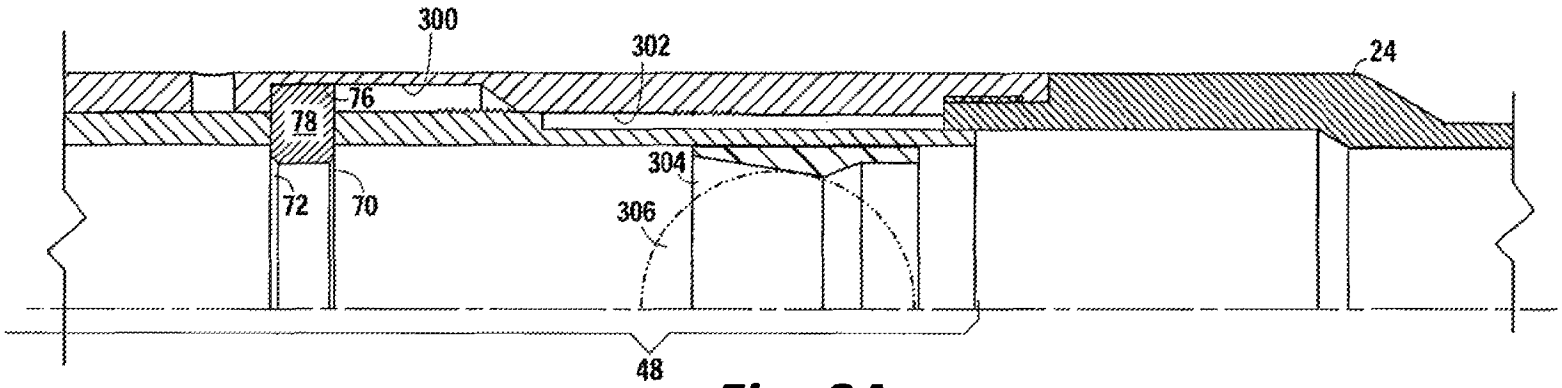
FIGS. 8A & 8B illustrate an alternative embodiment showing a valve assembly with two seating elements.
Figure 8B:
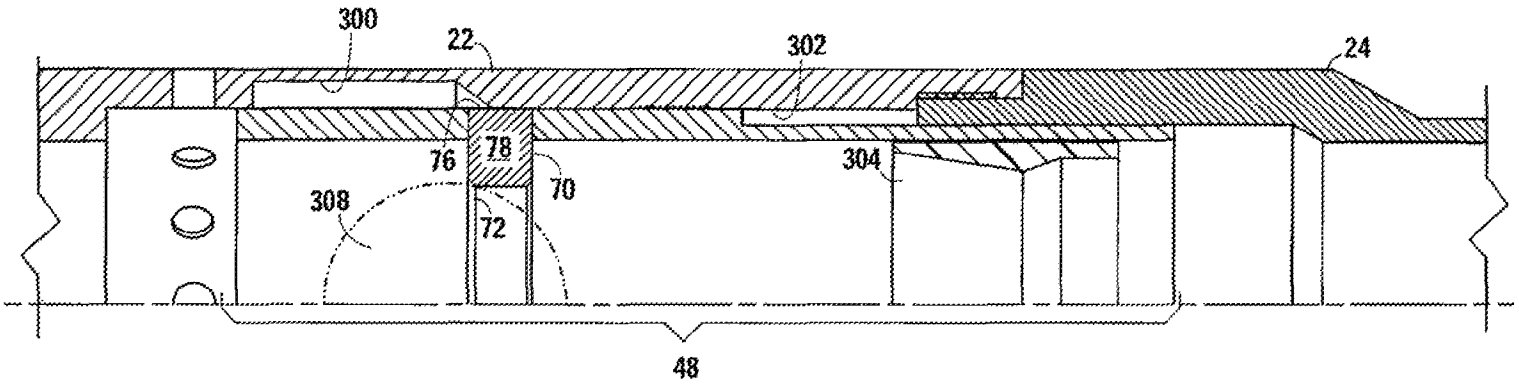

FIGS. 8A-8B show yet another embodiment in which a C-ring 70 starts in an uncompressed state and a sleeve 48 is oriented such that the protrusions 78 comprising the outer surface of the C-ring are in a larger-diameter section 300 of the housing 22 (shown in FIG. 8A) The sleeve 48 is then shifted to the position shown in FIG. 8B so that the protrusions 78 or forced from the larger-diameter section 300 to a smaller-diameter section 302 of the housing 22, which forces the C-ring 70 to a compressed state. Thereafter, a properly-sized ball flowing 308 through the sleeve would seat against compressed C-ring 70.

Still referring to FIG. 8A-8B, a system incorporating the above-described embodiments may comprise multiple ball seats, including multiple C-rings initially in either compressed and uncompressed states. One such system would have an upper C-ring 70 fixed to the sleeve 48 and a lower seat 304 spaced sufficiently apart to allow a first ball 306 of a particular size to seat on the lower seat 304 without engaging or interfering with the upper seat 72. Systems in which the first ball engages the upper seat 72 without interfering with the lower seat 304 are also possible. A first ball 306 engages the lower seat 304 and, using fluid pressure, shifts the sleeve 48 to allow compression of the upper seat 72 by positioning the upper seat 72 such that the outer surface 76 of the C-ring 70 engages a smaller diameter surface 302 or appropriately positioned dogs. The C-ring 70 of the upper seat 72 becomes compressed and can thereafter engage a second ball 308 of a diameter selected for use with the upper seat 72. Those of skill in the art will appreciate that, in the uncompressed state, the upper C-ring 70 is configured such that balls large enough to engage the lower seat 300 will pass without engaging the upper C-ring 70. Further, the upper C-ring 70, when compressed, will engage balls with a diameter that is too small to engage and hold pressure on the lower seat 304.

One advantage to the system illustrated in FIGS. 8A-8B is that restrictor elements which would activate the sleeve if the C-ring were compressed can pass through the valve assembly of this embodiment to activate tools further downwell. In other words, this embodiment will allow the placement of valve seats configured to utilize smaller restrictor elements upwell of valve seats configured to use larger restrictor elements. This will increase the flexibility of systems incorporating such valve assemblies and can increase the number of valves that can be operating in a single well.

This arrangement can be continued with any number of valve assemblies in series per stage, with no limit on the number of sleeves. Moreover, this system allows for an increase in the number of stages. For example, a trio of tools using single valve seats configured for a 2.0 inch, 1.875 inch, and 1.75 inch ball respectively, can be placed in a well. A second trio of tools using double valve seats with upper valves configured for use with 2.0 inch, 1.875 inches, and 1.75 inches are then placed upwell of the first trio. The upper valve seats of this second trio of stages are C-rings in the uncompressed state (as described with referenced with respect to FIG. 8A) such that a 2.0 inch ball can pass through each upper seat without engaging the seat sufficiently to move the valve assembly in a downwell direction. The lower valve seats of the second trio comprise C-ring valve seats configured to engage a 2.0 inch ball and to shift the assembly in response thereto.

In operation, a first 1.75 inch ball is placed in the well and allowed to engage and activate the 1.75 inch stage of the first trio of stages. A first 1.875 ball is placed in the well and allowed to engage and activate the 1.875 inch stage of the first trio of stages. Following the 1.875 inch ball, a first 2.0 inch ball is placed in the well. This ball first engages the lower seat of the 2.0 inch stage of the second trio of stages causing the seat to shift and moving the upper ring from an uncompressed state to a compressed state. The first 2.0 ball then engages the lower seat of the 1.875 inch stage of the second trio of stages, causing the seat to shift and moving the upper ring from an uncompressed to a compressed state. The first 2.0 inch ball then engages the lower seat of the 1.75 inch stage of second trio of stages, causing the seat to shift and moving the upper ring from an uncompressed state to a compressed state. Finally, the first 2.0 inch ball engages the 2.0 inch stage of the first trio of stages and activates the tools associated with the valve assemblies of this stage.

At this point, three stages, associated with a 1.75 inch, a 1.875 inch, and a 2.0 inch valve assembly have been activated. Further, the well now contains three additional stages that can be activated by sequentially placing a 1.75 inch ball, a 1.875 inch ball, and 2.0 inch ball into the well and allowing the balls to engage their respective seats. This means that 6 stages, each stage having the potential for multiple sleeves, can be activated through use of 3 ball sizes. Further, the embodiments are not limited to the nesting of three sizes. Further nesting is possible with the valve assemblies and method of use contemplated herein, such nesting limited only by the ability of the uncompressed ring to allow larger sized balls to pass without shifting the seat.

It is possible that the lower seat is not a C-ring but rather a solid seat for the ball or other restrictor means. Such a solid seat can be paired with the applicants' resilient deformable ball, described in applicant's U.S. patent application Ser. No. 13/423,154, entitled "Downhole System and Apparatus Incorporating Valve Assembly With Resilient Deformable Engaging Element," filed Mar. 16, 2012 and incorporated by reference herein, to allow for engagement and subsequent release of the lower seat. In fact, any method or device for engaging the lower seat to initially shift the sleeve is permissible provided that it does not prevent the treatment of any previously untreated stage.

Figure 9A:
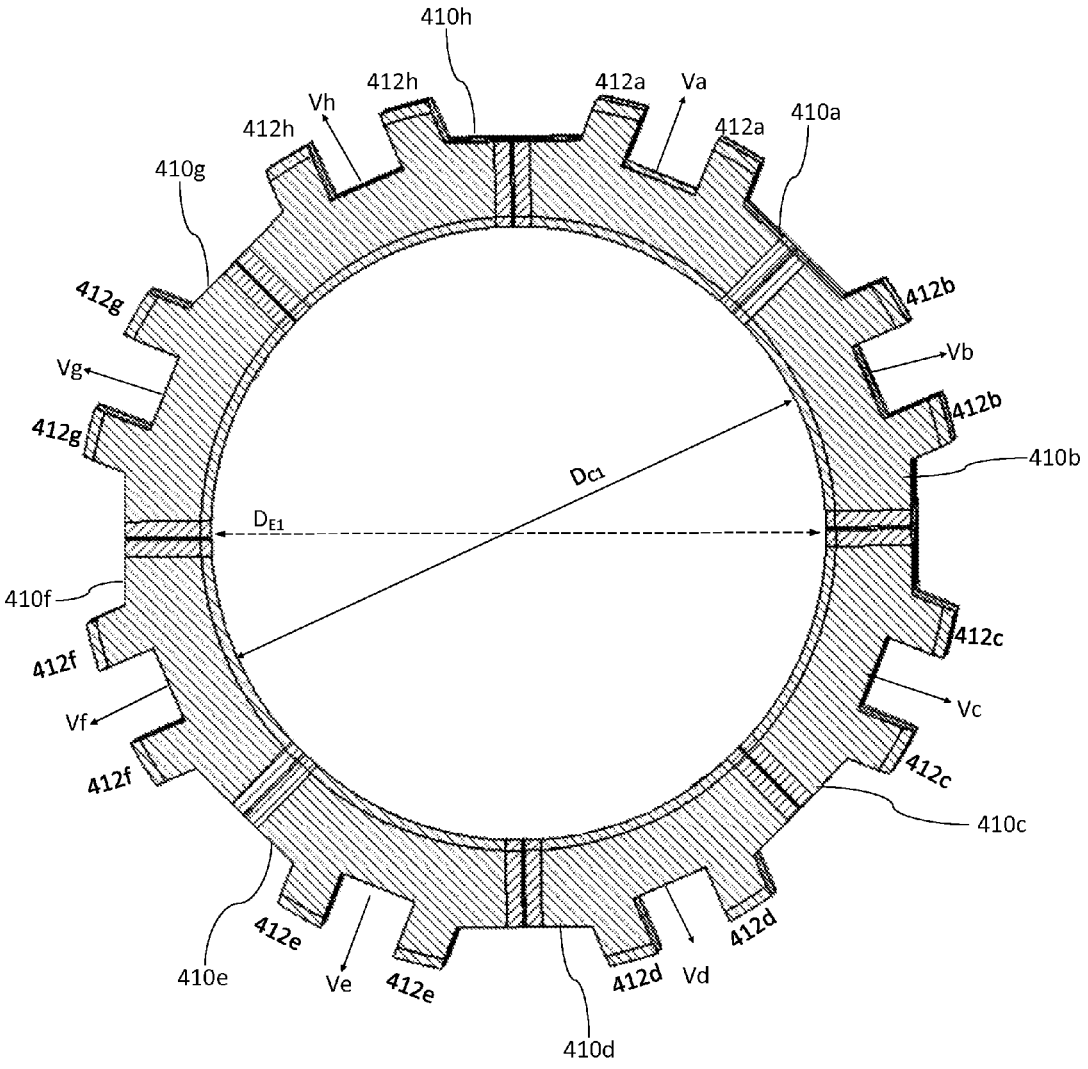
FIGS. 9A, 9B and 9C shown an embodiment split ring with multiple seat segments.
Figure 9B:
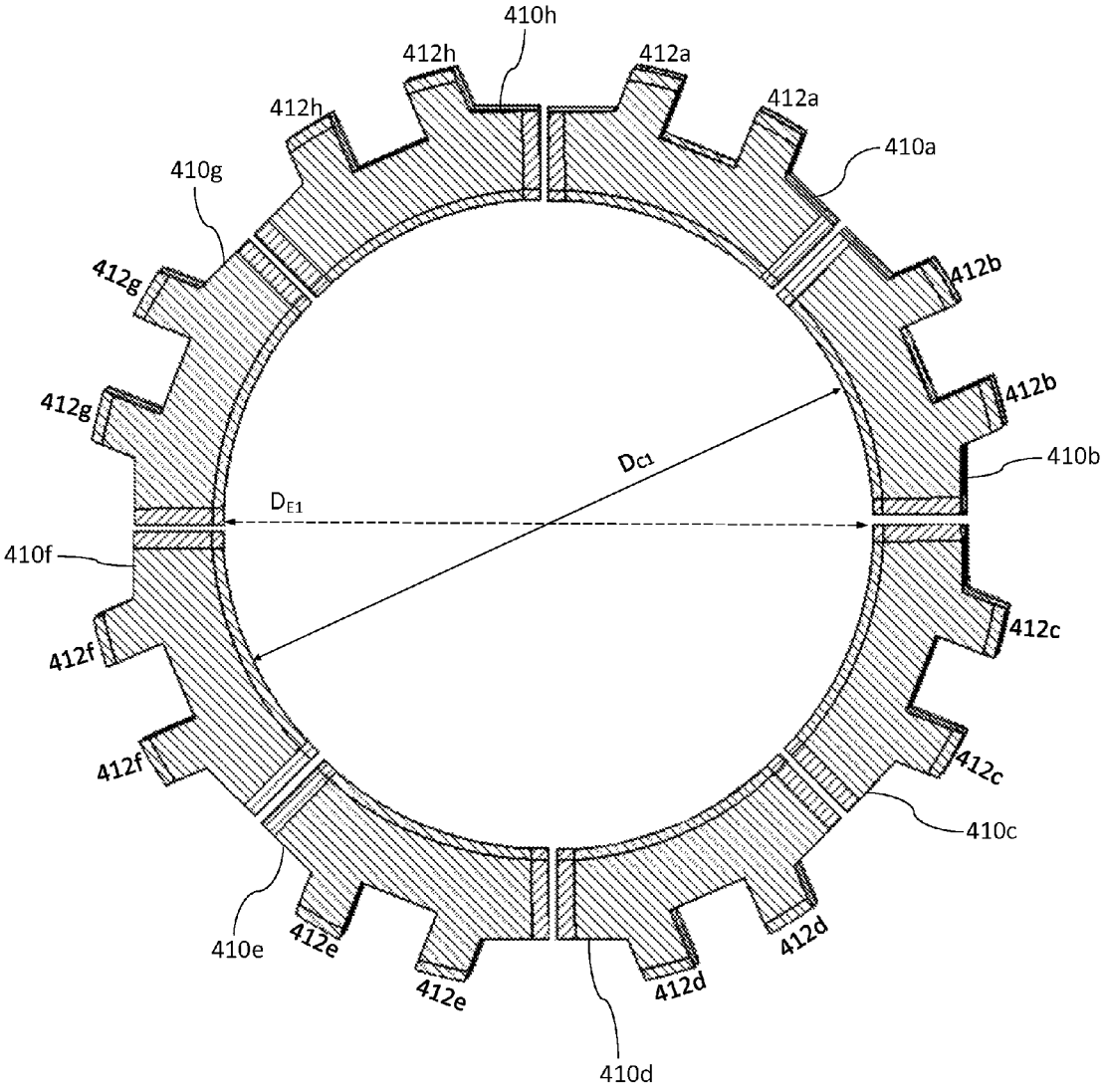
Figure 9C:
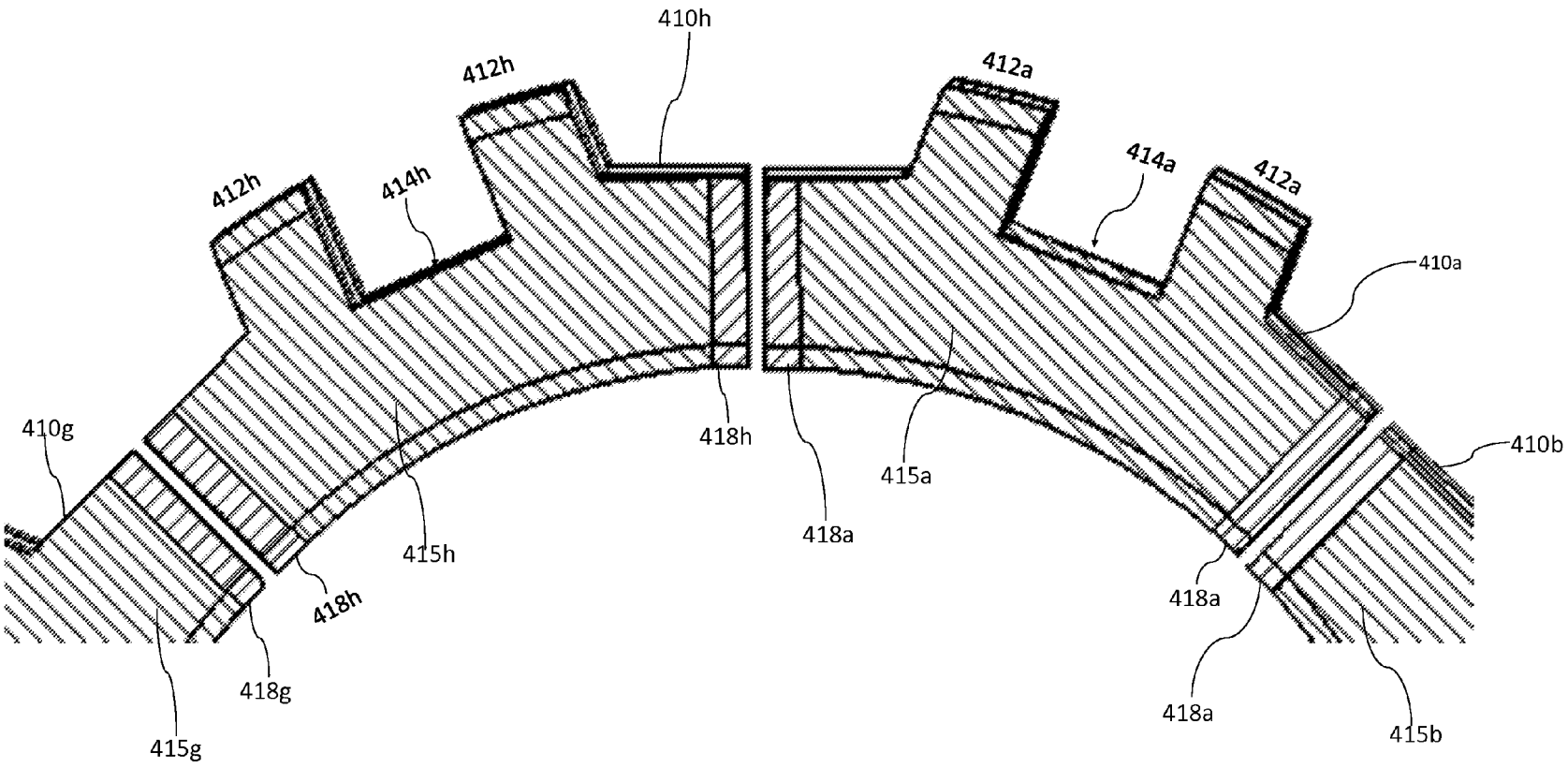

In another aspect, the expandable or collapsible split ring may be split in two or more locations, creating a multi-segmented ring. One embodiment of a multi-segmented ring is shown in a compressed or closed configuration in FIG. 9A and in an open configuration in FIGS. 9B and 9C. The illustrated ring in FIGS. 9A and 9B is composed of 8 separate segments, but more or fewer segments are within the scope of the present disclosure. The segments (410*a* thru 410*h*) are configured such that, when the ring is the compressed state, the segments abut tightly against one another to create a fluid seal when engaged by a plug. In the expanded state, the segments (410*a* thru 410*h*) pull away from each other, effectively increasing the diameter of the seat such that a plug that engages the compressed multi-segmented ring and creates a fluid seal by such engagement, can pass through the multi-segmented ring when it is in the open configuration.

Figure 10A:
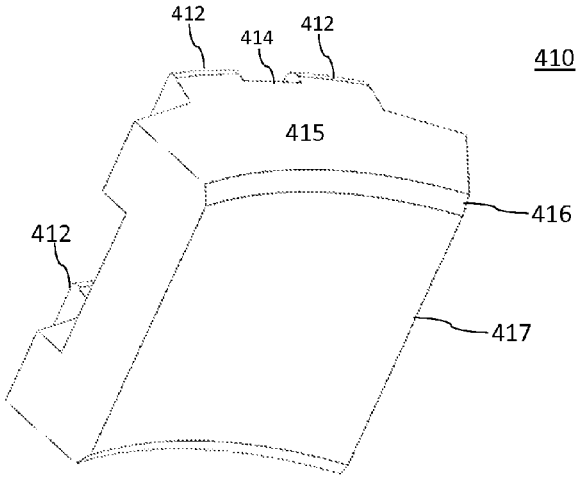
FIGS. 10A, 10B, and 10C show various views of one segment of multi-segment split ring.
Figure 10B:
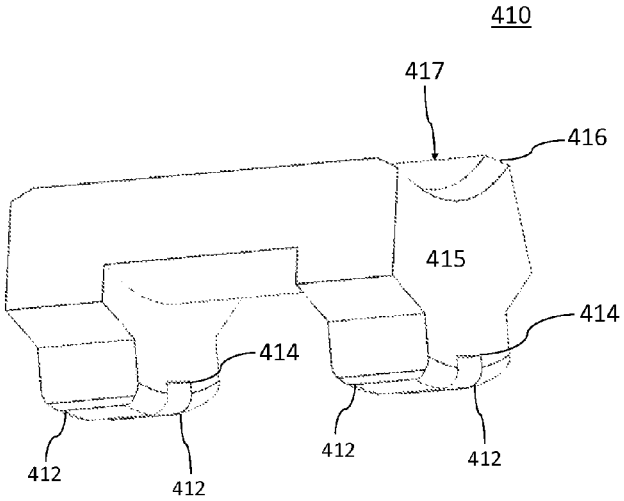
Figure 10C:
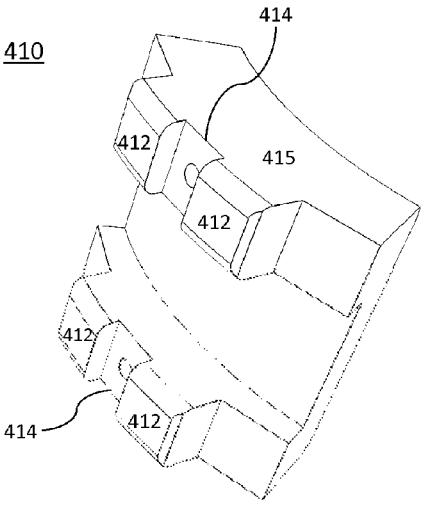

In the embodiment of FIGS. 9A and 9B, each segment 410*a* thru 410*h* comprise at least one post or protrusion 412*a* thru 412*h*. Some embodiments have more posts 412, such as is shown in FIG. 10A-C, which may be spaced both radially and longitudinally relative to the segment and/or the sleeve, if any, in which the segments may mounted, as well as the tubing string. The segments may be arranged to enable independent movement, such as movement along a vector (Va thru Vh) that is substantially perpendicular to the center of the applicable segment's face. In such arrangement, the segments 410 are configured such that each segment may move radially outward to increase the distance between the opposing points across the ring.

With reference to FIG. 10, each segment 410 has a face, such as radially curved face 417, a top 415 and a bottom, a seating surface 416 for engaging and sealing against an appropriately configured plug, such as a ball, dart, or other instrumentality. In the compressed or closed position, the faces 417 and seating surfaces 416 of the multiple segments 410*a* thru 410*h* combine form a substantially continuous curved inner surface and sealing surface, respectively, each of which may be circular or substantially circular in certain embodiments.

The segments have an edge 418 which may be of the same material or a different material as the other portions of the face 417, seating surface 416, top 415 and bottom of the segment. In one embodiment, the edge 418 may comprise an elastomer material to help reduce or eliminate damage to the plug as it passes through the expanded or opened multi-segmented plug seat. Further, such elastomer may facilitate the creation, or improvement, of a fluid seal between the segments when the multi-segmented seat is in the closed or compressed position.

The illustrated embodiment multi-segmented rings have a diameter $D_C$ from the center of the arc of one ring to the center of the arc of the opposing ring. Such rings also have a diameter $D_E$ from the edge of each segment to the corresponding edge on the opposing segment. For rings having a substantially circular face and seat surface $D_C$ and $D_E$ have substantially the same value for the closed ring shown in FIG. 9A. In the open position, e.g. the segments are expanded apart relative to one another as in FIG. 9B, the diameter has increased such that $D_{C2}$ is larger than $D_{C1}$ (FIG. 9A), due to movement of the segments. Further, diameter $D_{E2}$ in FIG. 9B is greater than $D_{E1}$ in FIG. 9A, but smaller than $D_{C2}$ of FIG. 9B. It will appreciated that this occurs because each segment expands through movement along a single vector rather than expanding radially along the segments entire arc. Further, in such embodiments $D_{E2}$ is the smallest clearance between opposing segments when the ring is in the open, or retracted, position. Therefore, in order to allow a plug that engages the seat when closed to pass the seat when open, the seat must be configured to expand such that $D_{E2}$ becomes large enough to allow the plug to pass, preferably without damaging the plug.

Multi-segmented seats may also have an odd number of segments, in which case the shortest diameter will not occur between two edges, but at a point along the face determined by the number of segments. Such arrangements are within the scope of embodiments encompassed by the present disclosure.

Figure 11A:
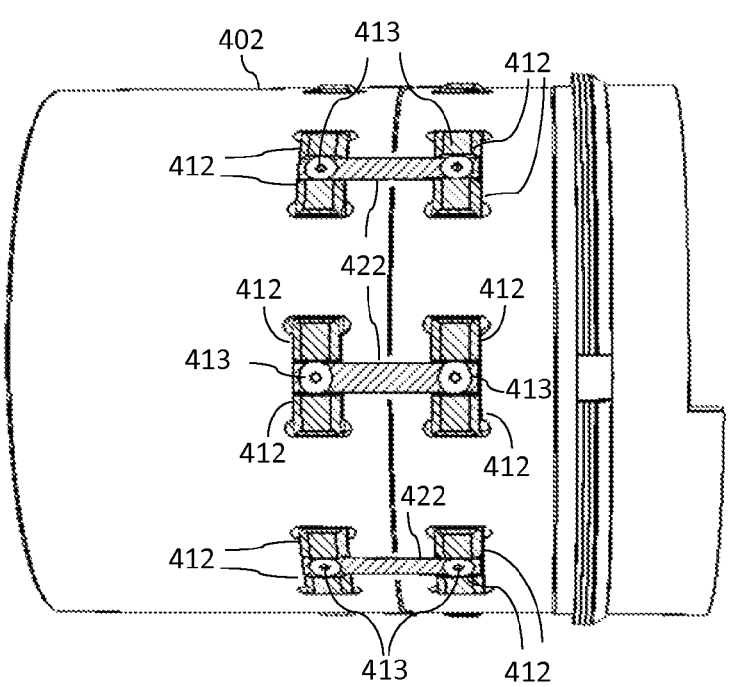
FIGS. 11A and 11B show one embodiment of a seat assembly for a multi-segmented seat.
Figure 11B:
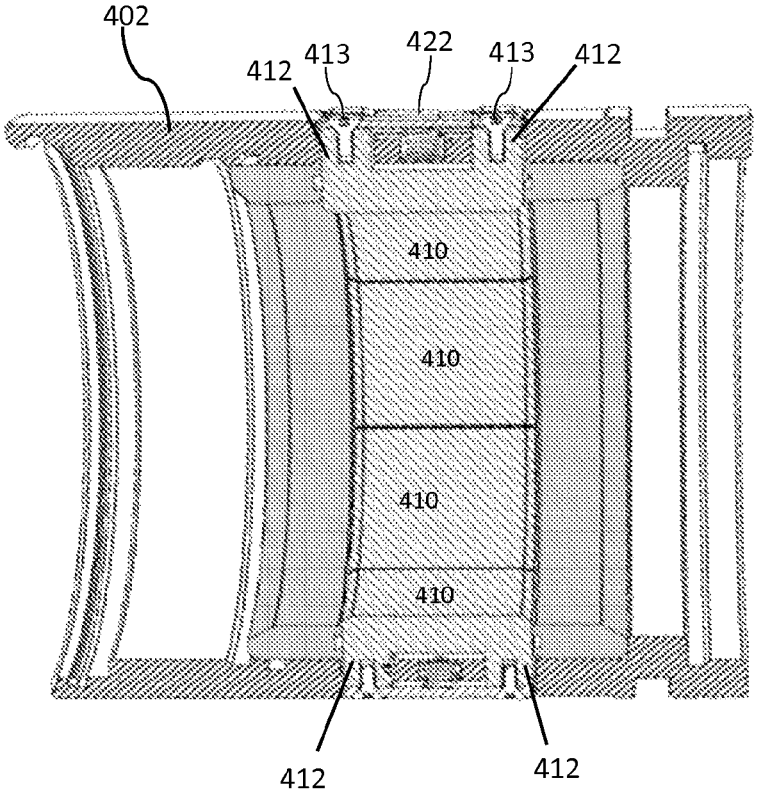

The plug seat comprising a multi-segmented ring may be disposed within a plug seat carrier, such as the plug seat carrier 402 shown in FIGS. 11A and 11B. The embodiment plug seat carrier 402 of FIGS. 11A and 11B may be a tubular element such as a sleeve comprising a plurality of openings therethrough. The openings are configured to allow passage of the posts 412 of each of the multi-segmented rings' segments 410. In some embodiments, the carrier 402 comprises a well 426 (FIG. 13) for mounting a spring and a plate. The spring 424 is compressed between the plate 422 and a surface of the well 426 and the plate 422 is connected to the segments 410, such as by screws 413, at niche 414 (FIG. 10) or other location near the posts 412 which protrude through the slots or holes in the plug seat carrier 402. In this configuration, the force of the spring 424 pushing on the plate 422 will tend to pull each segment 410 outward, via the screws 413, along a vector approximately parallel to the posts 412, such as along the vectors Va thru Vh illustrated in FIG. 9A. Any spring, such as disc springs, elastomer springs, or others, that provides sufficient force and travel in appropriate sizes may be used in place of the coil spring illustrated herein.

The carrier 402, segments 410, spring 424 and plate 422 may comprise a seat assembly 400. The seat assembly 400 may include additional components such as retainer rings 420*a* and 420*b* to secure the seats 410 longitudinally within the carrier. Seals, fasteners, and other elements may also be included to ensure that a pressure differential is created across the seat assembly 400 when an appropriate plug engages the seating surfaces 416 of the segments 410.

Figure 12:
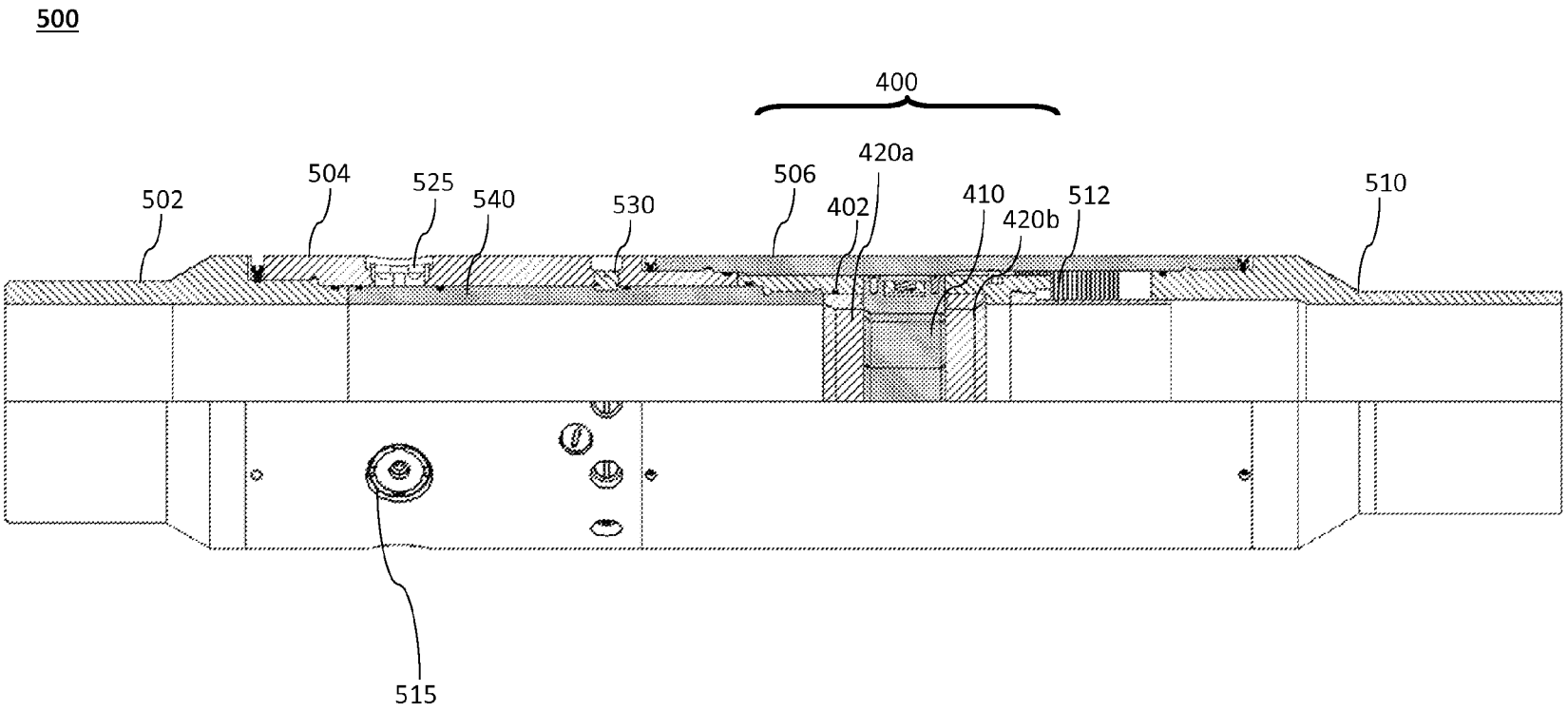
FIG. 12 shows a ported sleeve assembly comprising a multi-segmented seat according to the present disclosure.

FIG. 12 shows one example tool in which the multi-segmented seat may be used. The use of plug seats is known in the art and segmented seats may be used as desired in any of such tools or in future tools utilizing plug seats. The example tool of FIG. 12 is a frac sleeve 500, having first and second end connections (502 and 510), a ported housing 504, a sleeve housing 506. The frac sleeve 500 further comprises a port sleeve 540 connected to a seat assembly 400 such that the port sleeve 540 and the seat assembly will move laterally along the tool as a unit. In some embodiments, the tool may comprise a cement sleeve 512, also connected to the seat assembly 400, to prevent intrusion of cement or other materials below the seat assembly 400 and thereby preventing jamming of the tool 500 in the closed position. The seat assembly and port sleeve 540 have a first position and a second position. The tool 500 may have one or more shear pins 530 connecting the ported housing 504 to the port sleeve 540, or the seat housing 506 to one or more members of the seat assembly, thereby preventing movement of the port sleeve 540 and seat assembly until sufficient force, such as by a pressure differential across the seat assembly, is applied to break the shear pins.

Interior surfaces of first and second end connections (502, 510), port sleeve 540, seat assembly 400, cement sleeve (if present) at least partially define a flowpath through the tool 500. The ported housing 504 has one or more ports 525 providing fluid communication therethrough. In the first position, the port sleeve 540 prevents fluid communication from the flowpath of tool 500 to the exterior through ports 525. In the second position, not shown, the port sleeve 540 no longer covers the ports 525 and fluid communication between the flowpath and exterior of the tool 500 can occur.

Figure 13:
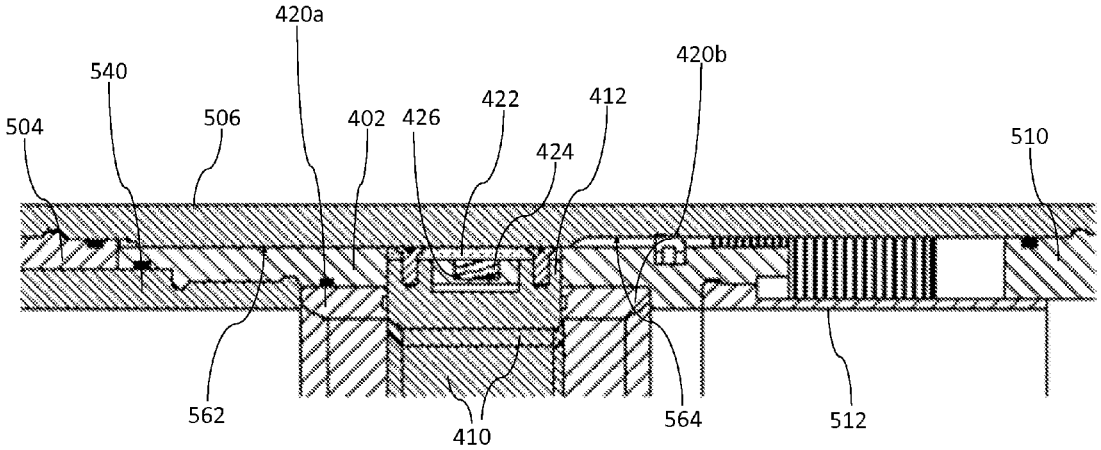
FIG. 13 shows an expanded view of the seat assembly and adjacent structures of the tool of FIG. 12 with the seat assembly in the first, compressed, position.

FIG. 13 shows an expanded view of the seat assembly 400 and adjacent structures of tool 500 from FIG. 12. FIG. 13 more clearly shows that seat housing 506 has an interior surface with a first diameter 562 and a second diameter 564, with first diameter 562 being smaller than the second diameter 564. When the seat assembly 400, and therefore the port sleeve 540, are in the first position, the seat assembly 400 is positioned in the seat housing 506 in a region having first diameter 562. The contact of the posts 412 and plates 422 with seat housing 506 in this location forces the edges (FIG. 9C 418) of segments 410 together, such as into the configuration shown in FIG. 9A. Thus, when segments 410 are engaged by an appropriate plug, a fluid seal is created, preventing fluid communication through the seat assembly 400 and facilitating generation of a pressure differential across the seat assembly 400 and engaged plug. When the force applied by such pressure differential is sufficient to overcome the shear pins 530, or other retention element, the port sleeve 540 and seat assembly 400 move to the second position.

Figure 14:
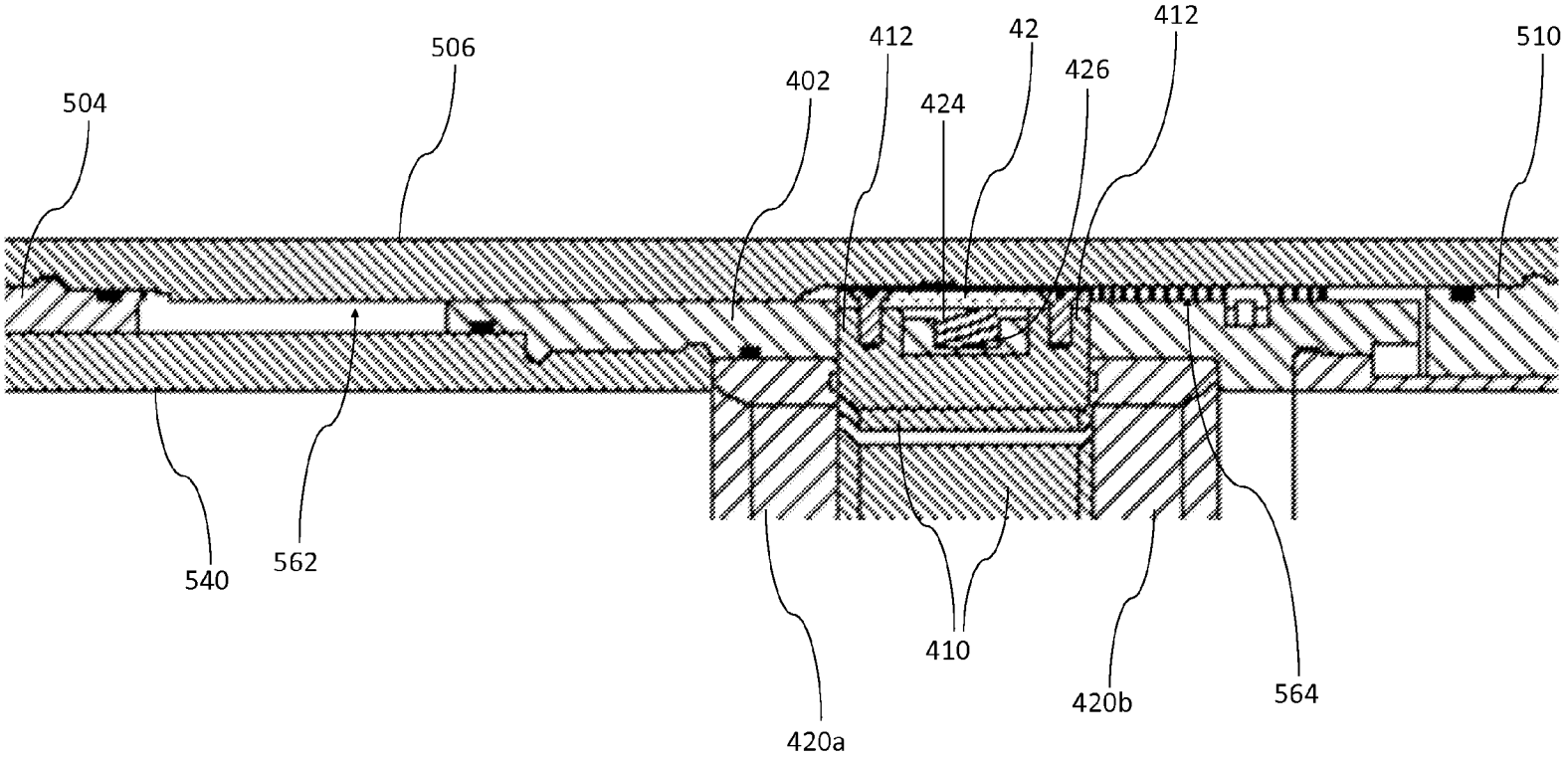
FIG. 14 shows an expanded view of the seat assembly and adjacent structures of the tool of FIG. 12 with the seat assembly in the second, expanded position.

FIG. 14 shows the region of tool 500 illustrated by FIG. 13, but with the seat assembly 400 in the second position. In this position, the segments 410 and plate 422 are adjacent to the seat housing 506 in a region having second diameter 564. Spring 424 pushes plate 422 towards the inner surface of the housing 506 in a direction approximately parallel to the posts 412. Plate 422 pulls segments 410 via posts 412 along this direction, pulling the segments apart. In this manner, longitudinal movement of seat assembly 400 translates into expansion of the seat into the open position because of the transition of seat assembly 400 into the second, larger, diameter 562 section of seat housing 506. When the difference between the first diameter 562 and the second diameter 564 is sufficiently large, a plug that seals against the multi-ring seat when the seat is in the first position can pass through the seat when seat assembly is in the second position—allowing the plug to pass further down the tubing and, if desired, actuate subsequent tools as discussed above.

The ball, plug, or other restrictor devices of the present valve assemblies can either seat on the split ring itself or the inside diameter of the sleeve above the split ring, where the sleeve is sized sufficiently small such that the ball creates a fluid seal between a plug and the sleeve, in which case the split ring provides mechanical engagement to prevent extrusion of the plug and allows the pressure differential across the plug and valve assembly necessary to shift the sleeve.

Figure 15:
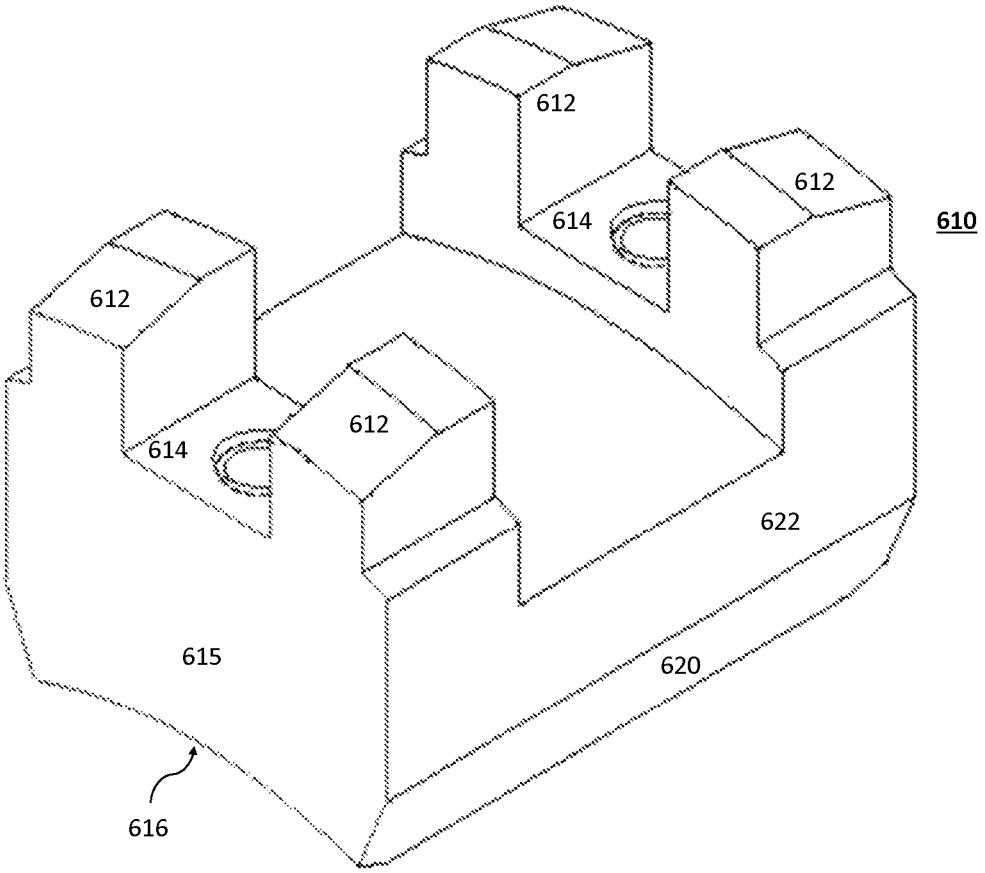
FIG. 15 shows another embodiment segment of a multi-segmented split ring.

FIG. 15 is an alternate embodiment segment of a multi-segment split ring. The segment 610 includes top 615, posts, 612, niche 614, radially curved face (not visible), sealing surface 616 in a manner similar to the segment 410 illustrated in FIG. 10. The segment of FIG. 15 has edge engagement face 620 and that transitions to a block face 622. In the illustrated embodiment, block face 622 is substantially parallel to the vector along which the segment will expand if installed in a valve of the present disclosure. Block face 622 of adjacent segments will not contact and seal with one another when the split ring is the closed position. Thus, embodiment valves incorporating such segments may require additional sealing elements, such as o-rings or other seals along top 615, not shown, to engage retainer ring **420*a*** and prevent fluid communication past the seat assembly through the gaps between adjacent segments.

The present disclosure contains descriptions of preferred embodiments in which specific systems and apparatuses are described. Those skilled in the art will recognize that alternative embodiments of such systems and apparatuses can be used. Other aspects and advantages of the embodiments of the invention as claimed may be obtained from a study of this disclosure and the drawings, along with the appended claims. Moreover, the recited order of the steps of any method described herein is not meant to limit the order in which those steps may be performed.

We claim:

1. A valve assembly for use in a subterranean well for oil, gas, or other hydrocarbons, said valve assembly comprising:

a housing having an interior surface with a first diameter and a second diameter, wherein the second diameter is larger than the first diameter;

an annular sleeve having an inner surface, an outer surface, and a plurality of openings extending between said inner surface and said outer surface;

a split ring for receiving a plug, the split ring comprising multiple segments and having a seating surface, at least two edges, an outer diameter with a plurality of protrusions extending outward from said outer diameter, at least one plate connected to said plurality of protrusions; and at least one spring engaging the plate and the annular sleeve;

wherein the split ring is at least partially within the inner surface of the sleeve, and the plurality of protrusions extends through the plurality of openings;

engagement of the spring with the at least one plate and the annular sleeve applies force for moving the split ring to the open position; and engagement of the protrusions with the interior surface of the housing at the first diameter moves the split ring to a closed position.

2. The valve assembly of claim 1 wherein said split ring further comprises at least one spring engaged with said annular sleeve, wherein the force applied by said spring is greater when the split ring is in the closed position than when the split ring is in the open position.

3. The valve assembly of claim 1, wherein said spring is more compressed when the split ring is in the closed position than when the split ring is in the open position.

4. The valve assembly of claim 1 wherein the split ring comprises an even number of segments.

5. The valve assembly of claim 1 wherein

The plurality of protrusions comprises at least two protrusions from each segment of the split ring;

The at least one plate comprises at least one plate for each segment;

wherein the at least one spring engages the annular sleeve and each segment of the split ring.

6. The valve assembly of claim 5, wherein the at least one spring comprises a plurality of springs and each of the plurality of springs engages one of the plurality of plates.

7. A split ring assembly for engaging a plug, said split ring assembly comprising:

an annular sleeve having an inner surface, an outer surface, and a plurality of openings extending between said inner surface and said outer surface, a plurality of segments, each segment having a body with a seating surface, at least two edges, and an outer diameter with at least one protrusion extending outward from said outer diameter, wherein the split ring is at least partially within the inner surface of the sleeve, and at least one of the protrusions of each of said plurality of segments extends through at least one of the openings, a plate connected to the at least one protrusion;

and at least one spring engaged with the plate and said annular sleeve, wherein the force applied by said spring is greater when the split ring is the closed position than when the split ring is in the open position.

8. The split ring assembly of claim 7 wherein said spring is more compressed when the split ring is in the closed position than when the split ring is in the open position.

9. The split ring assembly of claim 7 wherein said split ring comprises an even number of segments.

10. A method for treating a well for oil, gas or other hydrocarbons, the method comprising:

causing a first plug to pass through a first set of tools and a first sealing seat to at least one compressed split ring of a second set of tools, said split ring comprising a plurality of segments, each of said plurality of segments having a plurality of protrusions for engaging a variable diameter surface of a tubular surrounding said split ring and a spring element for pressing said protrusions against said variable diameter surface;

seating the first plug against the seating surface of the at least one compressed split ring, wherein the at least one compressed split ring is associated with at least one sleeve in a first position;

causing a pressure differential of a first pressure value across the first plug, said pressure value greater than an opposing force of at least one retention element to move the at least one sleeve to a second position wherein the at least one split ring becomes uncompressed; and causing the first plug to flow through the at least one split ring;

wherein the spring element comprises an annular sleeve, a plurality of plates and a plurality of springs, each of said plurality of plates connected to at least two of said protrusions and each of said plurality of springs engaging the annular sleeve and the at least one plate.

11. The method of claim 10 wherein the plurality of protrusions pass through penetrations in the annular sleeve; and the causing step comprises the spring applying force to the at least one plate to cause the at least one split ring to become uncompressed.

12. The method of claim 11 wherein the at least one spring comprises a plurality of springs, each of said springs engaging the annular sleeve and at least one plate; the causing step comprising the plurality of springs applying force to the plurality of plates to move the segments wherein the at least one split ring becomes uncompressed.

* * * * *